US005872322A

United States Patent [19]

Mocarski et al.

[11] Patent Number: 5,872,322

[45] Date of Patent: Feb. 16, 1999

[54] LIQUID PHASE SINTERED POWDER METAL ARTICLES

[75] Inventors: Stanislaw Mocarski, Toronto, Canada; Charles Oliver Mchugh, Dearborn Heights, Mich.; Russell A. Chernenkoff, Livonia, Mich.; David Alan Yeager, Plymouth, Mich.

[73] Assignee: Ford Global Technologies, Inc., Dearborn, Mich.

[21] Appl. No.: 794,745

[22] Filed: Feb. 3, 1997

[51] Int. Cl.[6] ..... B22F 3/12; C22C 33/02

[52] U.S. Cl. ..... 75/246; 419/46; 419/47

[58] Field of Search ..... 419/47, 46; 75/246

[56] References Cited

U.S. PATENT DOCUMENTS

| | | | |
|---|---|---|---|
| Re. 30,855 | 1/1982 | Chen . | |
| 3,676,103 | 7/1972 | Le Brasse et al. . | |
| 3,689,257 | 9/1972 | Oda et al. | 75/214 |
| 3,798,022 | 3/1974 | LeBrasse et al. . | |
| 3,901,661 | 8/1975 | Kondo et al. . | |
| 3,937,630 | 2/1976 | Kimura et al. | 75/200 |
| 3,982,907 | 9/1976 | Honma . | |
| 4,032,336 | 6/1977 | Reen . | |
| 4,035,159 | 7/1977 | Hashimoto et al. . | |
| 4,069,044 | 1/1978 | Mocarski et al. . | |
| 4,155,754 | 5/1979 | Lynn | 75/200 |
| 4,170,474 | 10/1979 | Chen . | |
| 4,251,273 | 2/1981 | Smith et al. . | |
| 4,253,874 | 3/1981 | Cundill . | |
| 4,266,974 | 5/1981 | Nitta et al. | 75/251 |
| 4,382,818 | 5/1983 | Mocarski | 419/11 |
| 4,501,613 | 2/1985 | Matsumoto . | |
| 4,524,046 | 6/1985 | Suganuma et al. . | |
| 4,599,110 | 7/1986 | Kohler et al. . | |
| 4,612,048 | 9/1986 | German et al. . | |
| 4,632,074 | 12/1986 | Takahashi et al. | 123/90.39 |
| 4,690,711 | 9/1987 | Coad | 75/244 |
| 4,696,696 | 9/1987 | Fujita et al. | 75/246 |
| 4,743,425 | 5/1988 | Ohsaki et al. | 419/6 |
| 4,849,164 | 7/1989 | Jandeska et al. | 419/11 |
| 4,885,133 | 12/1989 | Fujii . | |
| 4,891,080 | 1/1990 | Del Corso et al. . | |
| 4,919,719 | 4/1990 | Abe et al. . | |
| 4,966,626 | 10/1990 | Fujiki et al. . | |
| 4,996,022 | 2/1991 | Shindo et al. . | |
| 5,139,579 | 8/1992 | Kovac et al. . | |
| 5,154,881 | 10/1992 | Rutz et al. . | |
| 5,217,683 | 6/1993 | Causton . | |
| 5,221,321 | 6/1993 | Lim . | |
| 5,273,570 | 12/1993 | Sato et al. . | |
| 5,403,371 | 4/1995 | Enedahl et al. | 75/230 |
| 5,476,632 | 12/1995 | Shivanath et al. . | |
| 5,516,483 | 5/1996 | Shivanath et al. . | |
| 5,722,036 | 2/1998 | Shikata | 419/38 |

*Primary Examiner*—Daniel J. Jenkins
*Attorney, Agent, or Firm*—Joseph W. Malleck

[57] ABSTRACT

A method of making a structural iron-based article comprising: (a) blending a compressible base iron powder (max. particle size of 100 microns) a graphite powder to provide carbon in mixture, and a single master alloy powder (average particle size of 10 microns) meltable within the range of 900°–1200° C. (1690°–2220 °F.) to form a mixture, the master alloy powder being present in an amount of 1–5% by weight of the mixture and consisting of (i) hardenability enhancing alloying ingredients selected from Mn, Mo, Ni, Cr, Cu and Fe, with Fe being present only if Cr or Mo is selected and (ii) wetting agents selected from the group of B, Y, Si and rare earth misch metal, the master alloy being devoid of carbon and being proportioned to provide a desired amount of hardenability in the base powder; (b) compacting the mixture to a green density 7.1–7.4 g/cm$^3$ to form a green part (c) machining the green part to a desired configuration if necessary; (d) sintering the green part to achieve liquification of the master alloy to densify the part to 7.3–7.5 g/cm$^3$ without substantially varying the configuration of the green; and (e) cooling the sintered part at a controlled rate to form a desired microstructure such as essentially a bainite or ferrite/pearlite microstructure.

15 Claims, 2 Drawing Sheets

| Base Power | Master Alloy (wt % Ingredients) | Amount of Master Alloy (wt%) | Green Part Density ($g/cm^3$) Warm Press | Sintering Temp. (°C / °F) | Final Part Density ($g/cm^3$) | Yield Strength (KSI) | Ultimate Tensile Strength (KSI) | Elongation (%) | Unnotched Charpy Impact (ft - lbs.) | Apparent Hardness (Rockwell) C | Fatigue Strength (KSI) |
|---|---|---|---|---|---|---|---|---|---|---|---|
| 0.5 Mo Bal. Fe | 70 Mn/14 Cu /13 Ni 2.0 Si/1.0 RE | 1.0 | 7.4 | 1280 2340 | 7.5 | 74 | 101 | 3.5 | 21 | 22 | 35 |
| 0.5 Mo Bal. Fe | 69.8 Mn/13.8 Cu/12.8 Ni 1.9 Si /1.0 RE/0.7 B | 1.0 | 7.4 | 1280 2340 | 7.55 | 79 | 105 | 4.5 | 32 | 24 | 38 |
| 0.5 Mo Bal. Fe | 70 Mn/22 Cu /5 Ni 2 Si/1.0 RE | 1.0 | 7.35 | 1280 2340 | 7.5 | 75 | 104 | 4.0 | 30 | 22 | 36 |
| 0.5 Mo Bal. Fe | 70 Mn/14 Cu/12.3 Ni 1.85 Si/1.0 RE/.15 Y/.7 B | 2.5 | 7.4 | 1280 2340 | 7.55 | 71 | 98 | 3.2 | 26 | 21 | 34 |
| 0.85 Mo Bal. Fe | 70 Mn/14 Ni/14 Cu 2 Si | 1.0 | 7.35 | 1280 2340 | 7.45 | 72 | 100 | 3.3 | 30 | 22 | 34 |
| 0.85 Mo Bal. Fe | 70 Mn/14 Cu /12.85 Ni 2 Si /0.15 Y/1.0 RE | 4.0 | 7.30 | 1280 2340 | 7.4 | 73 | 101 | 3.2 | 31 | 28 | 33 |
| Fe | 70 Mn/14 Ni/14 Cu 2 Si | 3.0 | 7.35 | 1280 2340 | 7.5 | 74 | 102 | 3.8 | 31 | 25 | 37 |
| Fe | 50.2 Mn/21.2 Ni/7.7Cr 5.8 Mo/10.6 Fe 2.5 Si/1 RE | 2.5 | 7.30 | 1280 2340 | 7.4 | 71 | 99 | 3.4 | 32 | 24 | 32 |
| Fe | 50.1 Mn/21.1 Ni/2 Si 0.7 B/7.6 Cr/5.7 Mo 11.2 Fe/1.0 RE | 1.5 | 7.30 | 1280 2340 | 7.4 | 74 | 102 | 3.1 | 24 | 23 | 33 |

FIG.3

LIQUID PHASE SINTERED POWDER METAL ARTICLES

BACKGROUND OF THE INVENTION

1. Technical Field

This invention relates to the technology of producing high density metal powder alloy parts without forging and, more particularly to a process using liquid phase sintering that is dimensionally controllable to achieve a near net shape precision product with high density.

2. Discussion of the Prior Art

High density forming of powder metal is desirable because it increases the mechanical properties of the compacted metal, such as tensile strength, fatigue strength and impact strength. Prior art approaches to high density forming have included: (i) double-press double-sinter with sintering temperatures of 1120°–1200° C., (ii) heated pressing of powders wit a ferro-alloy admixture followed by high temperature sintering, and (iii) high temperature supersolidus sintering of high carbon prealloyed mixtures, such as disclosed in U.S. Pat. No. 5,476,632.

The problem with the double-press double-sinter approach is the high cost of extra processing and multiple equipment costs. The problem with heated pressing (about 300° F.) followed by high temperature sintering is the inability to control the swelling of the resulting metal since high temperature sintering of powders admixed with ferro alloys swells the compact undoing the benefits of heated pressing.

The problem with high temperature supersolidus sintering is the need for post-sintering operations to modify the shape of the carbide network formed during sintering and the need for delicate furnace controls to achieve only grain boundary melting; moreover the resultant compact is hard, containing carbide particles which are abrasive to tools and which present serious machining problems.

SUMMARY OF THE INVENTION

It is an object of this invention to provide a method of making a precision liquid phase sintered ferrous structural component by limiting dimensional change through a combination of using a higher density green compact and using faster liquid phase sintering involving master alloys to alloy the final compact. The sintering is performed in a reducing, low dew point, atmosphere. Shrinkage is provided by liquid phase sintering of the master alloy to counteract the swelling inherent in the diffusion of the alloying elements into the matrix. The addition of carbon is dictated by the final use of the component, e.g. carburized gears can be of low carbon, connecting rods can be a middle carbon range, while induction hardened parts can have a near eutectoid carbon (0.7–0.8% C) composition.

It is a further object of this invention to particularly enhance the fatigue strength of the final compact by liquid phase sintering using master alloys with a relatively low melting point to enhance shrinkage and thereby densification. The master alloys are formulated to increase the hardenability of the final compact. At least three are selected from the group of Mn, Ni, Cr, Cu, Mo and Fe as main alloying elements, iron being added only in the presence of Mo or Cr to lower the melting temperature of the master alloy. The melting range of the master alloys is 900°–1200° C. (1690°–2200° F.) with alloys at the lower end of the melting range being preferred. The base powder is either a highly compressible pure iron powder or an iron prealloyed with molybdenum (0.05 to 1.5 weight %) and added graphite.

It is a further object of this invention to provide a method to speed shrinkage and densification of the compact during the liquid phase sintering cycle by employing master alloys with wetting agents to produce a beneficial activated sintering reaction. It is advantageous if the master alloy contains wetting agents such as silicon, yttrium, rare earth metals and boron. The wetting agents reduce the surface tension of the master alloy by reacting with surface oxides of the base powder, allowing the alloy to wet the base powder surface and spread more rapidly. Capillary forces generated by the liquid solid interface at the wetted surfaces speed the sintering reaction.

In a first aspect, the invention is a method of making a structural iron-based article comprising: (a) blending a compressible base iron powder, a graphite powder to provide carbon in the mixture, and a single master alloy powder meltable within the range of 900°–1200° C. (1690°–2200° F.) to form a mixture, the master alloy powder being present in an amount of 1–5% by weight of the mixture and consisting of (i) hardenability enhancing alloying ingredients selected from Mn, Mo, Ni, Cr, Cu and Fe, with Fe being present only if Cr or Mo is selected and (ii) wetting agents selected from the group of B, Y, Si and rare earth misch metal, the master alloy being devoid of carbon and being proportioned to provide a desired amount of hardenability in the sintered article; (b) compacting the mixture to a green density 7.1–7.4 g/cm$^3$ to form a green part (c) machining the green part to a desired configuration if necessary;(d) sintering the green part to achieve liquification of the master alloy to densify the part to 7.3–7.5 g/cm$^3$ without substantially varying the configuration of the green part; and (e) cooling the sintered part at a controlled rate to form a desired microstructure such as essentially a bainite or ferrite/pearlite microstructure, while avoiding additional heat treatment.

It is preferred that the maximum particle size of the base powder be not more than 100 microns and the average particle size of the master alloy powder be about 10 microns. Advantageously the mixture may further comprise one or more organic compounds to provide lubrication, anti-dusting, and anti-segregation during mixing.

In a second aspect, the invention is a liquid phase sintered automotive structural component having a steel composition consisting of an iron alloy with alloying ingredients of molybdenum, nickel, copper, manganese and up to 0.5% by weight carbon, the composition have a density of 7.3–7.5 g/cm$^3$, a porosity of about 7%, an ultimate tensile strength of about 103 ksi, a yield strength of about 77 ksi, an apparent hardness of Rockwell C 20–26, an unnotched sharpy impact value of 18–32 ft.-lbs. and an elongation of 3.5–4.5%.

BRIEF DESCRIPTION OF THE DRAWINGS

FIG. 3 is a table of actual and projected data illustrating variation of certain physical parameters as a function of composition, density and master alloy melting temperature.

DETAILED DESCRIPTION AND BEST MODE

The automotive industry has been reluctant to adopt high temperature liquid phase sintering as the process of choice for making high-volume high-performance production parts, such as connecting rods, because of the fear of too large a tolerance or variability of part configuration, as well as the fear of field performance of parts with some porosity. Although these fears have been dispelled by favorable production experience in recent years, attaining small tolerances and limited porosity is still elusive at reduced costs. The method herein overcomes such cost considerations by limiting the volume and melting temperature of the liquid phase to that which counterbalances variability tendencies, alters the needed sintering temperature while enhancing shrinkage to achieve good hardenability and improved fatigue strength without brittleness while avoiding the presence of carbides that detract from machinability.

Figure 1:
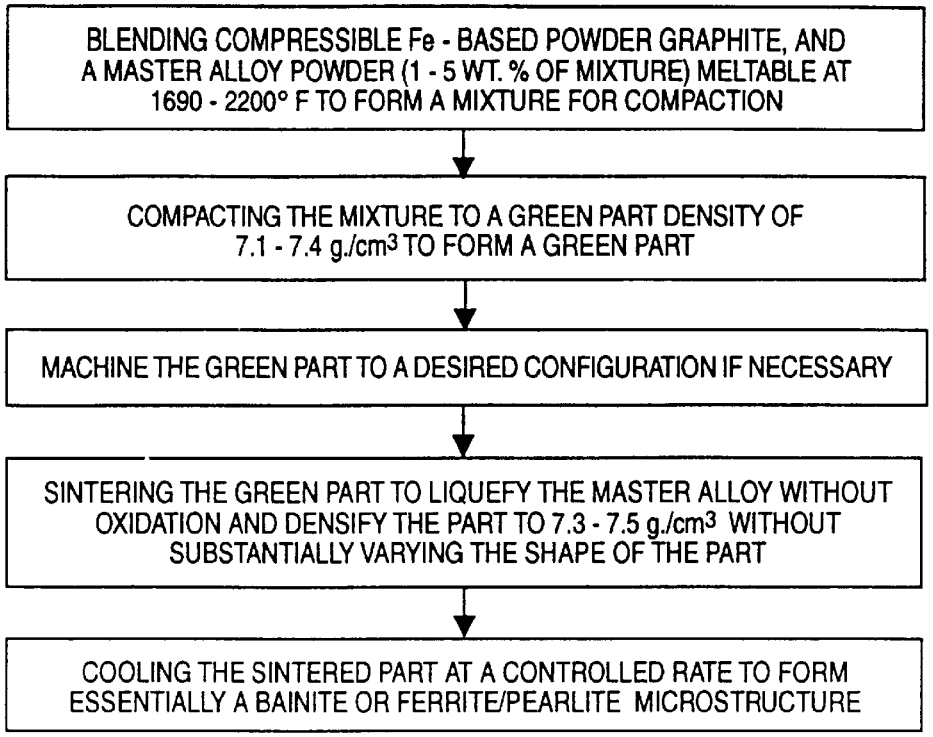
FIG. 1 is a block diagram of the basic steps of this invention.

As shown in FIG. 1, the method comprises essentially the steps of: blending powders, compacting the powder mixture, machining the green compact or part, if needed, sintering the compact or part, and cooling the sintered part to obtain the desired microstructure. In the first step, powder supplies are blended and mixed in a suitable blending apparatus. Commercially available binder treating methods of the powder manufacturers may be used to avoid segregation of the alloying additions. The powder supplies for blending comprise a compressible base iron powder consisting of Fe or Fe alloyed with Mo (0.05–1.5 wt % Mo) a graphite powder to supply 0.1–0.8 wt % carbon if not present in the other powders; and a single master alloy powder consisting of (i) hardenability enhancing alloys selectively including Mn, Ni, Cu and selectively Cr, Mo (Fe is present if Cr or Mo is selected), and (ii) wetting agents selected from B, Si, Y and rare earth misch metal (R. E.). Boron when selected, is preferably less than 0.6 wt. % of the sintered part. The base powder is present in an amount of 95–99% by weight of the mixture and the master alloying powder is present in an amount of 1–5% by weight of the mixture. Within such parameters, the chemistry is selected and the weight proportioned not only to provide for melting of the master alloy powder in the range of 900°–1200° C. (1690°–2200° F.) but also to obtain the desired degree of shrinkage and diffusion.

The maximum particle size of the iron-based powder is about 100 microns, and the average particle size of the master alloy powder may be an average of about 10 microns with the maximum particle size being 40 microns. Each powder must be essentially pure with the impurity content no greater than 0.5 Wt. %. The mixture may also contain up to 0.6%, by weight, of organic compounds to act as either pressing lubricants or compounds to minimize dusting or to prevent segregation of the powders.

Compacting of step two may be carried out in steel dies having the shape of the part to be produced; compaction is effected by use of mechanical or isostatic presses to achieve a green density of 7.1–7.4 g/cm$^3$ (90–94% of theoretical density). Compaction may be carried out at room temperature or at an elevated temperature, such as 250°–300° F., to activate any pressing lubricant present in the mixture. Advantageously only a small amount of admixed lubricant may be used during heated compaction; such lubricant is liquid during compaction and allows the particles to rotate to occupy the least volume position.

Green part machining, if desired or needed, can be carried out as a third step to define the desired configuration. Green part machining gives enhanced tool life while facilitating easy and accurate machining.

The fourth step comprises sintering in a furnace with a controlled non-oxidizing atmosphere at a temperature at about 2340° F. (1280° C.) to effect liquification of the master alloy containing the metal wetting agents to thereby promote surface tension and capillary forces that enhance densification to 7.3–7.5 g/cm$^3$ and reduce porosity in the sintered part to 7% or less. The ingredients in the liquid master alloy diffuse into the solid particles of the iron-based powder to enhance hardenability (response to heat treatment) and thereby develop essentially a homogeneous bainite or ferritic/pearlitic microstructure, upon controlled cooling from the sintering temperature. The required hardness and microstructure are achieved during sintering; thus the need for additional heat treatment is eliminated.

The sintering temperature is selected based on the optimum diffusion of alloying ingredients of the master alloy into the iron-based powder. Such temperature is advantageously selected to be at least 80° C. (150° F.) in excess of that needed to melt the master alloy to a liquid phase. The furnace atmosphere must exhibit a low oxygen potential to prevent or minimize loss of alloying effectiveness of the master alloy ingredients. This is offset by maintaining an ultra low dew point of −35 °to −60° F. A suitable sintering atmosphere includes vacuum, inert gases, and nitrogen atmospheres containing reducing gases such as $H_2$ or CO. The sintering temperature, as selected, will maintain dimensional stability of the shape of the component during liquid phase sintering. The wetting agents promote quick spreading of the liquid phase to accelerate diffusion of the master alloy ingredients into the base powder (the diffusion tending to swell the part) while surface tension and capillary action of the liquid phase provides forces to counteract any swelling and thereby stabilize the part. Dimensional and shape stability depends on both the amount of master alloy incorporated into the mixture and on the actual sintering temperature relative to the melting range of the master alloy. Optimizing compaction density and sintering temperature will provide for shape stability.

Figure 2:
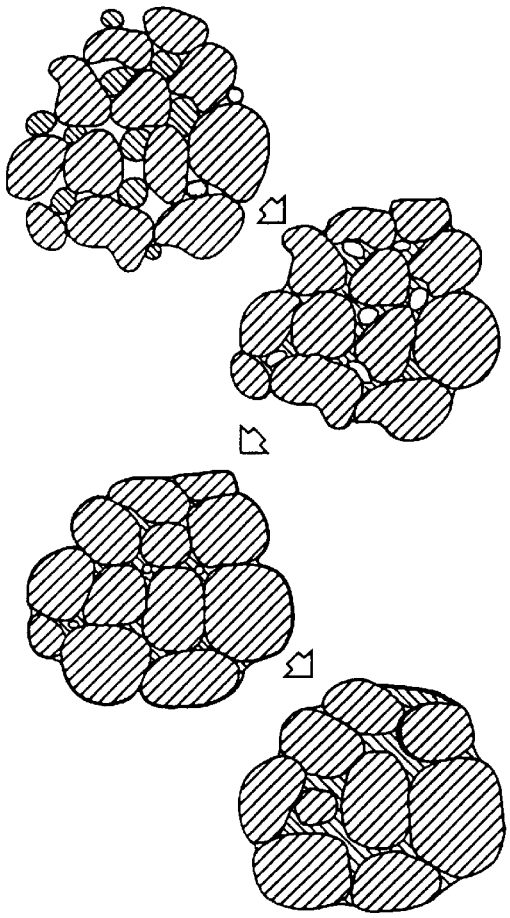
FIG. 2 is a schematic diagram of the stages of liquid phase sintering employing the mechanism of this invention.

As shown in FIG. 2, the sequence of operations of the liquid phase sintering method according to this invention comprises heating the machined green part to the sintering temperature (phase 1), melting of the master alloy particles in phase 2 to form a liquid that, due to capillary and surface tension forces, spreads out along the iron-based powder particles to reduce the porosity therebetween. Metallurgical diffusion of the liquid alloying ingredients takes place into the iron-based powder particle surfaces (phase 3); there is some solid particle shape accommodation that counteracts any swelling due to diffusion to thereby reduce porosity substantially and maintain stability of the machined green part shape (phase 4).

The invention, in a second aspect, is a liquid phase sintered automotive structural component having a steel composition consisting of an iron alloy having at least three alloying ingredients selected from molybdenum, nickel, copper, manganese and graphite, with the final carbon content of the sinter part being limited to 0.1–0.8 weight %, the composition having a density of 7.3–7.5 g/cm$^3$, a porosity of about 7% or less, an ultimate tensile strength of about 103 ksi, a yield strength of about 77 ksi, an apparent hardness of Rockwell C 20–26, an unnotched sharpy impact value of 18–32 ft.-lbs., and an elongation of 3.5–4.5%. As shown in the table of FIG. 3, representative examples of actual and projected properties of parts produced by the method of this invention are shown; physical properties shown are a function of powder chemistry and compaction. The physical properties include final density, yield strength, ultimate tensile strength, hardness, elongation sharpy impact values, and fatigue strength.

While particular embodiments of the invention have been illustrated and described, it will be obvious to those skilled the art that various changes and modifications may be made without departing from the invention, and it is intended to cover in the appended claims all such modifications-and equivalents as fall within the true spirit and scope of this invention.

We claim:

1. A method of making a structural iron-based article comprising:

(a) blending a compressible iron-based powder and 1–5% by weight of a master alloy powder meltable in the temperature range of 900°–1200° C. (1690°–2200° F.) to form a mixture having admixture graphite in the range of 0.1–0.8% by weight;

(b) compacting said mixture to a green density of 7.1–7.4 g/cm$^3$ to form a green part;

(c) machining the green part to a desired configuration if necessary;

(d) sintering the green part to effect liquification of only the master alloy without oxidation to densify the green part to 7.3–7.5 g/cm$^3$ without substantially varying the configuration of the part; and (e) cooling the sintered part at a rate to form essentially a ferrite/pearlic microstructure.

2. The method as in claim 1 in which said master alloy has at least three selected from the group of Mn, Ni, Cu, Mo and Fe, Fe being selected only if Mo or Cr is selected.

3. The method as in claim 1, in which said master alloy powder contains metal alloy wetting agents to promote enhanced sintered density.

4. The method as in claim 3 in which said wetting agents are selected from the group consisting of boron, silicon, yttrium and rare earth misch metal, with boron being less than 0.6% by weight of the part.

5. The method as in claim 1, in which step (d) is carried out in an atmosphere constituted to prevent formation of oxides at the lower sintering temperature and has a low dew point of −35° to −60° F.

6. The method as in claim 1, in which said iron-based powder has a maximum particle size of about 100 microns and said master alloy has an average particle size of about 10 microns to enhance part hardenability.

7. The method as in claim 1, in which the base powder consists of iron or an iron alloyed with 0.05–1.5% by weight Mo has admixed graphite, and said master alloy consists of (i) hardenability enhancing alloying ingredients selected from Mn, Mo, Ni, Cr and Cu, Fe being added if Mo or Cr is selected and (ii) alloying wetting agents selected from the group of boron, silicon, yttrium and rare earth misch metal.

8. The method as in claim 1, in which step (b) is carried out by use of warm pressing.

9. The method as in claim 8, in which said warm pressing is carried out in the temperature range of 250°–300° F.

10. A method of making a structural iron-based article, comprising;

(a) blending a compressible iron-based powder, graphite powder and a master alloy powder meltable at 900°–1200° C. (1690°–2220° F.) to form a mixture, said master alloy powder being present in an amount of 1–5% by weight of the mixture and consisting of (i) hardenability enhancing alloying ingredients selected from Mn, Mo, Ni, Cu and Cr, with Fe being added if Cr or Mo is selected, and (ii) wetting agents selected from the group of B, Si, Y and R.E. (rare earth misch metal), said graphite being present in an amount to provide a carbon content in the article of 0.1–0.8 weight %;

(b) compacting said mixture to a green density of 7.1–7.4 g/cm$^3$ to form a green part;

(c) machining the green part to a desired configuration if necessary;

(d) sintering said green part in a non-oxidizing atmosphere having a dew point of −35° F. or lower and at a temperature that is at least about 80° C. (150° F.) in excess of that needed to melt the master alloy to thereby form a liquid phase that densities said green part to a density of 7.3–7.5 g/cm$^3$ while limiting any deviation of the shape of the part, said wetting agents promoting quick spreading of the liquid phase to accelerate diffusion of the master alloy ingredients into the iron based powder that may attempt to swell the part, while surface tension of the liquid phase provides forces to shrink the part while counteracting any swelling and thereby stabilize the part shape; and (e) cooling the sintered part at a rate to form a desired microstructure in the article.

11. A method of making a structural iron-based article, the method comprising;

(a) forming a uniformly blended powder mixture of 95–99% by weight of a base powder, and 1–5% by weight of a single master alloy powder, the base powder consisting of Fe or Fe alloyed with 0.5–1.5% MO and has 0.1–0.8% admixed graphite, said master alloy consisting of (i) hardenability enhancing alloying ingredients selected from Mn, Mo, Ni, Cr and Cu, Fe being added if Mo or Cr is selected, and (ii) alloying wetting agents selected from the group of B, Si, Y and R.E. the master alloy being proportioned to produce the desired hardenability in the final part;

(b) mechanically or isotatically compacting the mixture to a green density of 7.1–7.3 g/cm$^3$ to form a green part;

(c) machining the green part to a desired configuration if necessary;

(d) sintering the green part by heating to a temperature in the range of 2225°–2350° F. in a non-oxidizing atmosphere at a dew point of −35° to −60° F. to form a liquid phase of the master alloy powder which liquid effects densification of the green part by wetting of the solid particles and creation of strong capillary forces; and (e) cooling the sintered part at a rate to form a desired microstructure.

12. The method as in claim 11, in which when B is selected as an alloying wetting agent, it is restricted to less than 0.6% of the sintered article.

13. The method as in claim 11, in which said compacting is carried out by warm pressing at a temperature 250°–300° F.

14. The method as in claim 11, in which the atmosphere for sintering is provided by one of vacuum, inert gasses, or nitrogen accompanied by reducing agents such as $H_2$ or CO.

15. A liquid phase sintered automotive structural component having a steel composition consisting of;

(a) An iron alloy having at least three alloying ingredients selected from molybdenum, nickel, copper, manganese, and admixed graphite (carbon being limited to 0.1–0.8 weight %;) (b) a density of 7.3–7.5 g/cm$^3$ and a porosity of about 7%, (c)an ultimate tensile strength of about 103 ksi, a yield strength of about 77 ksi;

(d) an apparent hardness of Rockwell C 20–26; and (e) An unnotched sharpy impact value of 18–32 ft.–lbs. and an elongation of 3.5–4.5%.

* * * * *